US008270650B2

(12) United States Patent
Tada et al.

(10) Patent No.: US 8,270,650 B2
(45) Date of Patent: Sep. 18, 2012

(54) HEARING AID

(75) Inventors: Minoru Tada, Ehime (JP); Yosimasa Simogochi, Kanagawa (JP); Kazumasa Okamura, Ehime (JP)

(73) Assignee: Panasonic Corporation, Osaka (JP)

( * ) Notice: Subject to any disclaimer, the term of this patent is extended or adjusted under 35 U.S.C. 154(b) by 239 days.

(21) Appl. No.: 12/935,044

(22) PCT Filed: Nov. 27, 2009

(86) PCT No.: PCT/JP2009/006433

§ 371 (c)(1),
(2), (4) Date: Sep. 28, 2010

(87) PCT Pub. No.: WO2010/143242

PCT Pub. Date: Dec. 16, 2010

(65) Prior Publication Data

US 2012/0140968 A1 Jun. 7, 2012

(30) Foreign Application Priority Data

Jun. 9, 2009 (JP) ..... 2009-137875

(51) Int. Cl.
*H04R 25/00* (2006.01)

(52) U.S. Cl. ..... 381/330; 381/322; 381/328

(58) Field of Classification Search ..... 381/322, 381/324, 327–328, 330, 380–381; 379/430
See application file for complete search history.

(56) References Cited

U.S. PATENT DOCUMENTS

| | | | |
|---|---|---|---|
| 4,041,251 | A | 8/1977 | Kaanders |
| 4,622,440 | A | 11/1986 | Slavin |
| 4,727,582 | A | 2/1988 | de Vries et al. |
| 7,016,512 | B1 | 3/2006 | Feeley et al. |
| 7,110,562 | B1 | 9/2006 | Feeley et al. |
| 2004/0010181 | A1 | 1/2004 | Feeley et al. |
| 2006/0078141 | A1 | 4/2006 | Jessen et al. |
| 2007/0009130 | A1 | 1/2007 | Feeley et al. |
| 2007/0064965 | A1 | 3/2007 | Feeley et al. |
| 2007/0064966 | A1 | 3/2007 | Feeley et al. |
| 2007/0064967 | A1 | 3/2007 | Feeley et al. |
| 2009/0238390 | A1 | 9/2009 | Imai et al. |

FOREIGN PATENT DOCUMENTS

| | | |
|---|---|---|
| JP | 50-28707 | 3/1975 |
| JP | 57-46400 | 3/1982 |
| JP | 60-232800 | 11/1985 |
| JP | 60-244200 | 12/1985 |
| JP | 2008-48067 | 2/2008 |
| JP | 4124769 | 5/2008 |

*Primary Examiner* — Suhan Ni
(74) *Attorney, Agent, or Firm* — Wenderoth, Lind & Ponack, L.L.P.

(57) ABSTRACT

A hearing aid, wherein a front sound opening and a front microphone are acoustically connected via a front sound guide path, and the front sound guide path includes a first space formed between the front microphone and the electrical connection part inside the main body case, and a second space formed between the electrical connection part and the inner wall face of the main body case.

5 Claims, 7 Drawing Sheets

HEARING AID

TECHNICAL FIELD

The present invention relates to a BTE (Behind-The-Ear) hearing aid.

BACKGROUND ART

A conventional BTE (Behind-The-Ear) hearing aid comprises an ear hook that is bent so as to fit the ear, an earphone linked to the front end side of this ear hook, and a main body case linked to the rear end side of the ear hook. The ear hook has wiring that electrically connects the earphone and the main body case. An electrical connection part and a microphone are provided in that order from the front end side toward the rear end side inside the main body case. A front sound opening is provided to the front end side portion of the outer wall face of the main body case, and a rear sound opening is provided to the portion of the outer wall face of the main body case that is to the rear of the front sound opening (see Patent Literature 1 below, for example).

When this hearing aid is used, first the ear hook is hooked over the top of the ear, and then the earphone is placed against or inserted into the ear canal in this state. The main body case has a shape that hangs down while curving in a parabolic form from the front end side toward the rear end side thereof, so when the hearing aid is put on, this main body case is disposed along the rear side of the ear.

CITATION LIST

Patent Literature

Patent Literature 1: U.S. Pat. No. 4,124,769

SUMMARY

Technical Problem

With the prior art above, in order to determine whether the sound source is in front of or behind the user, the front sound opening and rear sound opening are provided a specific distance apart in the front and rear direction (more specifically, the front and rear direction of the user wearing the hearing aid), which makes it possible to determine whether the sound source is in front or behind on the basis of which sound opening hears the sound first.

Here, ideally the front sound opening and rear sound opening are separated in the horizontal direction (that is, the above-mentioned front and rear direction) enough to determine whether the sound source is in front or behind. However, as mentioned above, the main body case is disposed along the rear of the ear, and has the shape that hangs down while curving in the parabolic form from the front end side toward the rear end side. Therefore, the distance between the front sound opening and rear sound opening in the horizontal direction is smaller. Accordingly, the front sound opening and rear sound opening cannot be separated sufficiently in the horizontal direction, and as a result, it is sometimes difficult to tell whether the sound source is in front or behind.

In view of this, it is an object of the present invention to make it easier to tell whether the sound source is in front or behind.

Solution to Problem

The hearing aid pertaining to the present invention comprises an ear hook bent for hooking, an earphone linked to a front end side of the ear hook, and a main body case linked to a rear end side of the ear hook. The ear hook has a wiring electrically connecting the earphone and the main body case. The main body case has a electrical connection part electrically connected with the wiring, a front microphone, and a rear microphone provided in that order, from the front end side to the rear end side of the main body case, inside the main body case, a front sound opening provided to the outer peripheral portion of the electrical connection part or to the front end side portion of the main body case from the electrical connection part, out of the outer wall face of the main body case; and a rear sound opening provided to the rear of the front sound opening out of the outer wall face of the main body case. The front sound opening and the front microphone are acoustically connected via a front sound guide path. The front sound guide path includes a first space formed between the front microphone and the electrical connection part inside the main body case, and a second space formed between the electrical connection part and the inner wall face of the main body case. The rear sound opening and the rear microphone are acoustically connected.

Advantageous Effects

With the hearing aid pertaining to the present invention, since a front sound opening is provided to the outer peripheral portion of an electrical connection means out of the outer wall face of the main body case, or to the front end side portion of the main body case from the electrical connection means, the front sound opening can be disposed more on the front end side of the main body case than in the past. Consequently, the front sound opening and rear sound opening can be spaced sufficiently apart in the horizontal direction (the front and rear direction when the hearing aid is worn). As a result, it is easier to tell whether the sound source is in front or behind.

DESCRIPTION OF EMBODIMENTS

A hearing aid pertaining to an embodiment of the present invention will now be described through reference to the drawings. In the following description of the drawings, components that are the same or similar will be numbered the same or similarly. The drawings, however, are merely schematics, and the size proportions and so forth may differ from the real ones. Therefore, specific dimensions and so forth should be determined by reference to the following description. Also, it should go without saying that the proportions and relations between sizes may vary from one drawing to another.

In the following description, the terms "top," "bottom," "front," "rear," "left," "right," and "horizontal" should be interpreted by using frame of reference of the person wearing the hearing aid.

Embodiments

FIGS. 1A and 1B and FIGS. 2A to 2D illustrate a hearing aid pertaining to an embodiment of the present invention, which is worn on the right ear. The hearing aid pertaining to this embodiment, as shown in FIGS. 1A and 1B and FIGS. 2A to 2D, comprises an ear hook 1 that is bent substantially in an arc shape for hooking, an earphone 2 linked to the front end side of the ear hook 1 (more specifically, to the lower end of the portion extending downward from the front end of the ear hook 1), and a main body case 3 linked to the rear end side of the ear hook 1.

As shown in FIGS. 1A and 1B and FIGS. 2A to 2D, the main body case 3 has a shape that hangs down while curving in a parabolic form from the front end side toward the rear end side thereof. The main body case 3 is disposed along the rear of the ear when the hearing aid is put on by the user. That is, when this hearing aid is used, first, the ear hook 1 is hooked over the top of the ear, and then the earphone 2 is brought into contact with, or inserted into, the ear canal (not shown) in this state, so that the main body case 3 is disposed along the rear of the ear as mentioned above.

Figure 3:
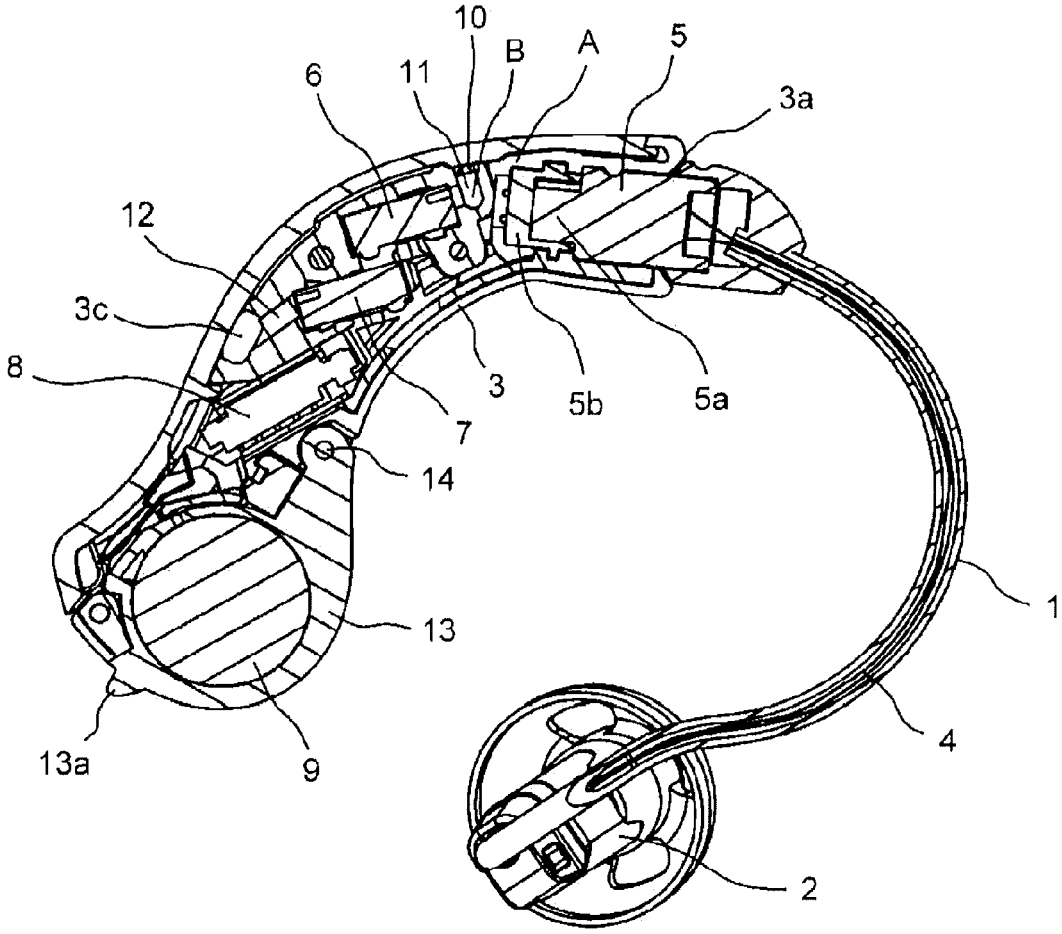
FIG. 3 is a front cross section of the hearing aid pertaining to an embodiment of the present invention.

As shown in FIG. 3, the ear hook 1 contains wiring 4 that electrically connects the earphone 2 and the main body case 3. Also, as shown in FIG. 3, an electrical connection part 5, a front microphone 6, a rear microphone 7, a control element 8, and a battery 9 are installed in that order inside the main body case 3, from the front end side toward the rear end side. Furthermore, the rear end side of the front microphone 6 and the front end side of the rear microphone 7 overlap in the lengthwise direction (that is, in a direction along the curved shape of the main body case 3) between the front and rear ends of the main body case 3 inside the main body case 3 as shown in FIG. 3.

Also, as shown in FIG. 3, the rear end side of the rear microphone 7 and the front end side of the control element 8 overlap in the lengthwise direction between the front and rear ends of the main body case 3 inside the main body case 3. Thus, the front microphone 6, the rear microphone 7, and the control element 8 overlap in the lengthwise direction between the front and rear ends of the main body case 3 inside the main body case 3, as shown in FIG. 3. Consequently, the front microphone 6, the rear microphone 7, and the control element 8 are housed in a compact arrangement inside the main body case 3 having the above-mentioned curved shape.

The electrical connection part 5 in this embodiment is constituted by a plug 5*a* linked to the rear end of the wiring 4, and a receptacle 5*b* detachably linked to the plug 5*a* both mechanically and electrically. The electrical connection part 5 electrically connects the main body case 3 with the wiring 4 housed in the ear hook 1. As shown in FIG. 3, the receptacle 5*b* is disposed inside the main body case 3. Accordingly, when the plug 5*a* and the receptacle 5*b* are linked, the plug 5*a* is inserted into the main body case 3 through a front end opening 3*a* in the main body case 3, and is detachably linked to the plug 5*a* both mechanically and electrically.

In this embodiment, the plug 5*a* is provided to the ear hook 1, and the receptacle 5*b* is provided inside the main body case 3, but the present invention is not limited to this. For example, the plug 5*a* may be provided inside the main body case 3, and the receptacle 5*b* provided to the ear hook 1.

The main body case 3 can be used on either the left or right side. To convert the right-ear hearing aid shown in FIG. 3 for use on the left ear, a left-ear earphone (not shown), an ear hook 1, and a plug 5*a* are mounted, and this left-ear plug 5*a* is detachably linked to the receptacle 5*b* both mechanically and electrically. Naturally, in FIG. 3, rather than removing the plug 5*a* and the ear hook 1, just the right-ear earphone 2 may be removed and exchanged with the left-ear earphone (not shown).

Figure 1A:
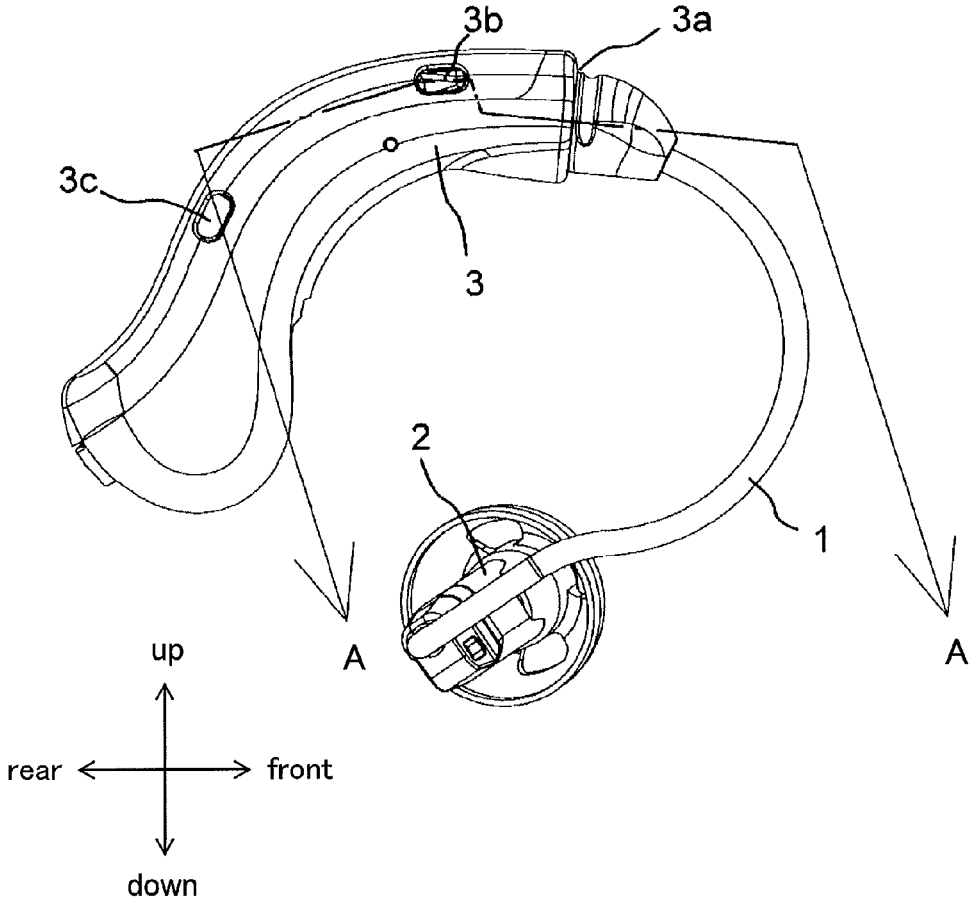
FIG. 1A is a front view of the hearing aid pertaining to an embodiment of the present invention.
Figure 1B:
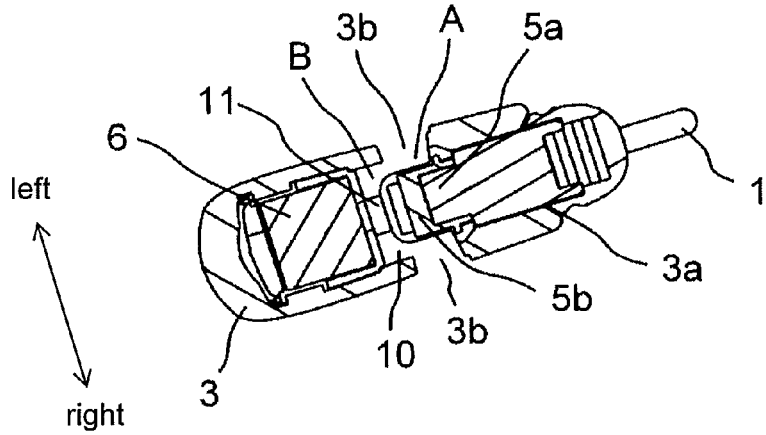
FIG. 1B is a cross section along the A-A line in FIG. 1A.
Figure 2A:
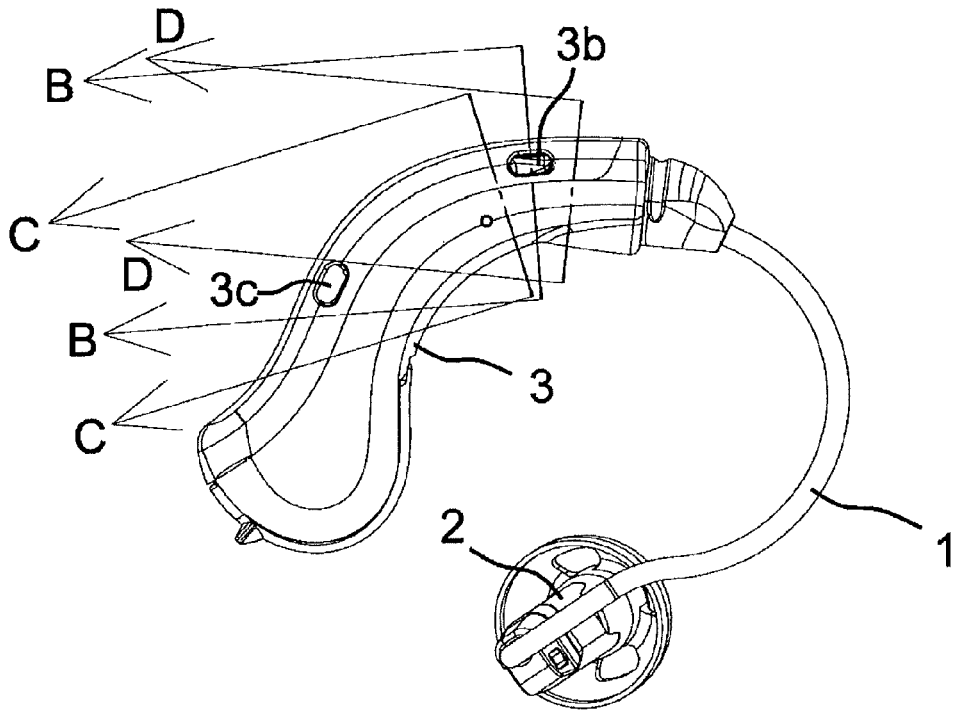
FIG. 2A is a front view of the hearing aid pertaining to an embodiment of the present invention.
Figure 2B:
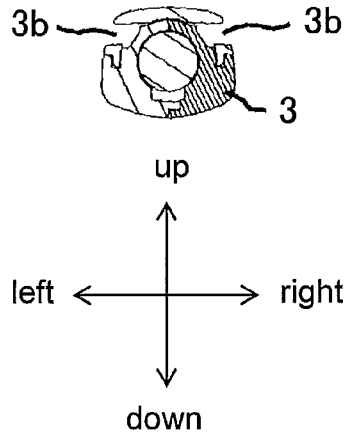
FIG. 2B is a cross section along the B-B line in FIG. 2A.
Figure 2C:
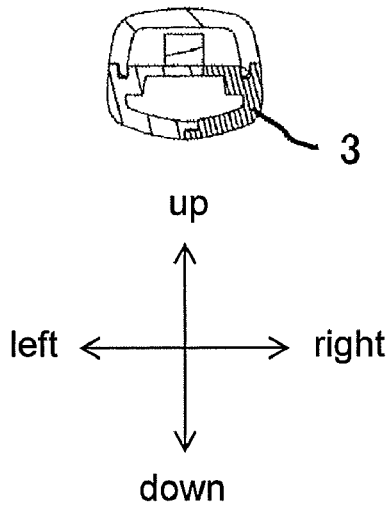
FIG. 2C is a cross section along the C-C line in FIG. 2A.
Figure 2D:
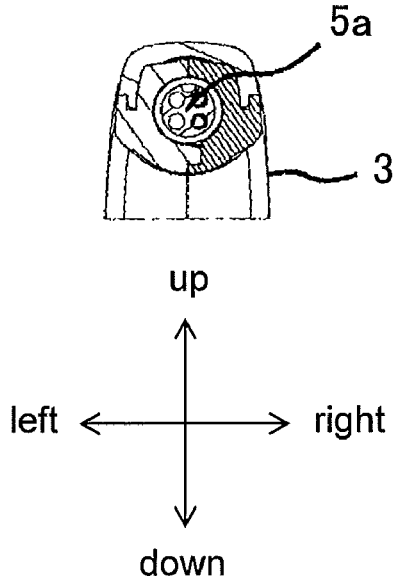
FIG. 2D is a cross section along the D-D line in FIG. 2A.

Out of the outer wall face of the main body case 3 that has this curved shape, a front sound opening 3*b* is provided to the outer peripheral portion of the receptacle 5*b* constituting the electrical connection part 5 (see FIGS. 1A and 1B). A rear sound opening 3*c* is provided to the outer peripheral portion of the control element 8 out of the outer wall face of the main body case 3, and to the rear of the front sound opening 3*b* (see FIG. 3).

As will be understood from FIGS. 1A and 1B, FIGS. 2A to 2D and FIG. 3, the front sound opening 3*b* and rear sound opening 3*c* are each constituted by a pair of sound openings provided on the left and right sides of the main body case 3, with the center being a line going from the front end side toward the rear end side of the main body case 3 (more specifically, a line along the lengthwise direction of the curved main body case 3; the lengthwise direction of the main body case 3). This is what allows the main body case 3 to be used for both left and right sides as mentioned above. However, the front sound opening 3*b* and the rear sound opening 3*c* may each be constituted by a single sound opening instead.

In this embodiment, as discussed above, the front sound opening 3*b* is provided to the outer peripheral portion of the receptacle 5*b* constituting the electrical connection part 5 out of the outer wall face of the main body case 3 with its curved shape.

This point will now be described in greater detail. As shown in FIG. 3, a space A (second space) is provided between the inner peripheral face of the main body case 3 and the receptacle 5*b* constituting the electrical connection part 5. The front sound opening 3*b* is provided to the portion of the outer wall face of the main body case 3 that surrounds the space A.

Also, as can be seen from FIGS. 1B and 3, a space B (first space) is provided between the receptacle 5*b* and the front microphone 6. The front sound opening 3*b* and the front microphone 6 are acoustically linked via a front sound guide path 10 formed by these spaces A and B. A dust filter 11 is provided to the portion of the front sound guide path 10 that is in front of the front microphone 6. Accordingly, sound that enters the main body case 3 through the front sound opening 3*b* is transmitted to the front microphone 6 via the front sound guide path 10 in which the dust filter 11 is disposed, and is converted into an electrical signal by this front microphone 6.

Similarly, sound that enters the main body case 3 through the rear sound opening 3*c* is transmitted to the rear microphone 7 via a rear sound guide path (not shown) in which a dust filter 12 is disposed, and is converted into an electrical signal by this rear microphone 7. The electrical signals outputted from the front microphone 6 and the rear microphone 7 are processed and amplified by the control element 8 and transmitted through the wiring 4 to the earphone 2, which results in a hearing aid action.

The effect of the above constitution in this embodiment is that the distance between the front sound opening 3*b* and the rear sound opening 3*c* in the horizontal direction (more specifically, the front and rear direction of the user) can be increased, so the time difference between sounds captured by the front sound opening 3*b* and the rear sound opening 3*c* can be increased. As a result, it is easier to tell whether the sound source is in front or behind.

Also, since there is ample distance between the front sound opening 3*b* and the rear sound opening 3*c*, the size of the main body case 3 itself can be reduced, and this makes the hearing aid more comfortable to wear.

A conventional example will now be described for the sake of comparison. With a conventional hearing aid, since the receptacle 5*b* is present inside the main body case 3, the front sound opening 3*b* has to be provided to the portion of the outer wall of the main body case 3 that surrounds the space B. Accordingly, with this conventional hearing aid, the distance between the front sound opening 3*b* and the rear sound opening 3*c* in the horizontal direction (the front and rear direction of the user) is smaller by an amount equivalent to the front sound opening 3*b*, for example, than with the hearing aid pertaining to the embodiment shown in FIG. 1. Accordingly, it is difficult to increase the time difference between sounds captured by the front sound opening 3*b* and the rear sound opening 3*c*. As a result, it is more difficult to tell whether the sound source is in front or behind.

In contrast, with this embodiment, the distance between the front sound opening 3*b* and the rear sound opening 3*c* in the horizontal direction (the front and rear direction of the user) can be increased over that of a conventional hearing aid by an amount equivalent to the front sound opening 3*b*, for example. Consequently, the time difference between the sounds captured by the front sound opening 3*b* and the rear sound opening 3*c* can be increased. As a result, it is easier to tell whether the sound source is in front or behind.

As discussed above, the main body case 3 is disposed along the rear of the ear, so the size in the horizontal direction is small in the first place. Accordingly, the fact that, as mentioned above, the distance between the front sound opening 3*b* and the rear sound opening 3*c* in the horizontal direction (the front and rear direction of the user) can be increased by even just an amount equivalent to the front sound opening 3*b* means that the time difference between the sounds captured by the front sound opening 3*b* and the rear sound opening 3*c* can be increased dramatically. As a result, it is easier to tell whether the sound source is in front or behind.

If the front sound opening 3*b* is provided to the portion of the outer wall of the main body case 3 that is more to the front end side than the outer peripheral portion of the receptacle 5*b*, then the above effect can be further enhanced. Here, the space A may be provided between the inner wall face of the main body case 3 and the plug 5*a* shown in FIG. 1B.

Figure 4:
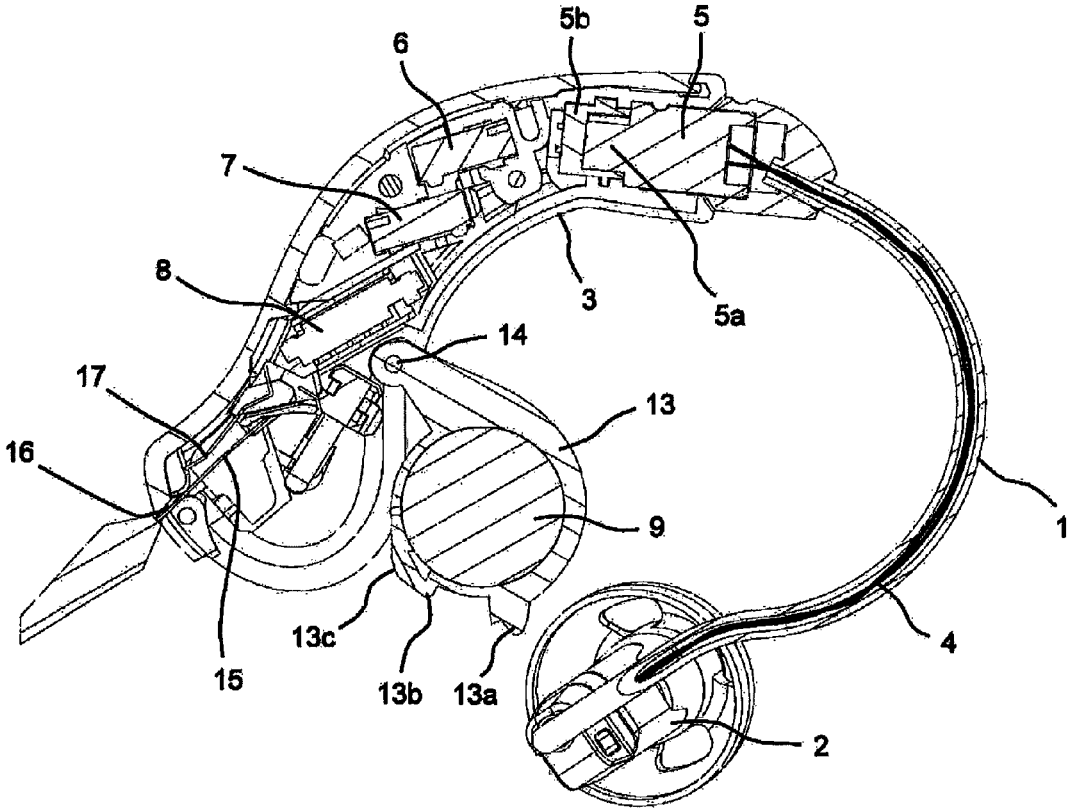
FIG. 4 is a front cross section of the hearing aid pertaining to an embodiment of the present invention.
Figure 5:
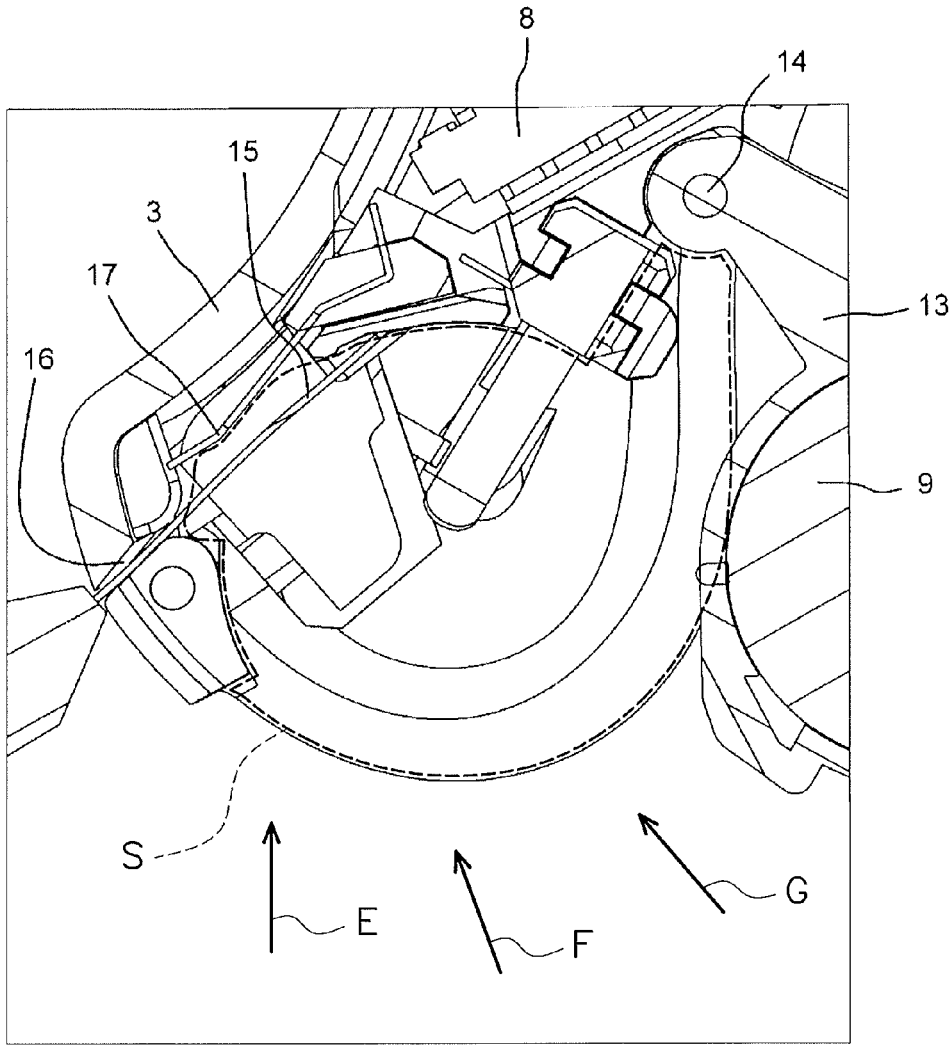
FIG. 5 is a front detail cross section of the hearing aid pertaining to an embodiment of the present invention.
Figure 6:
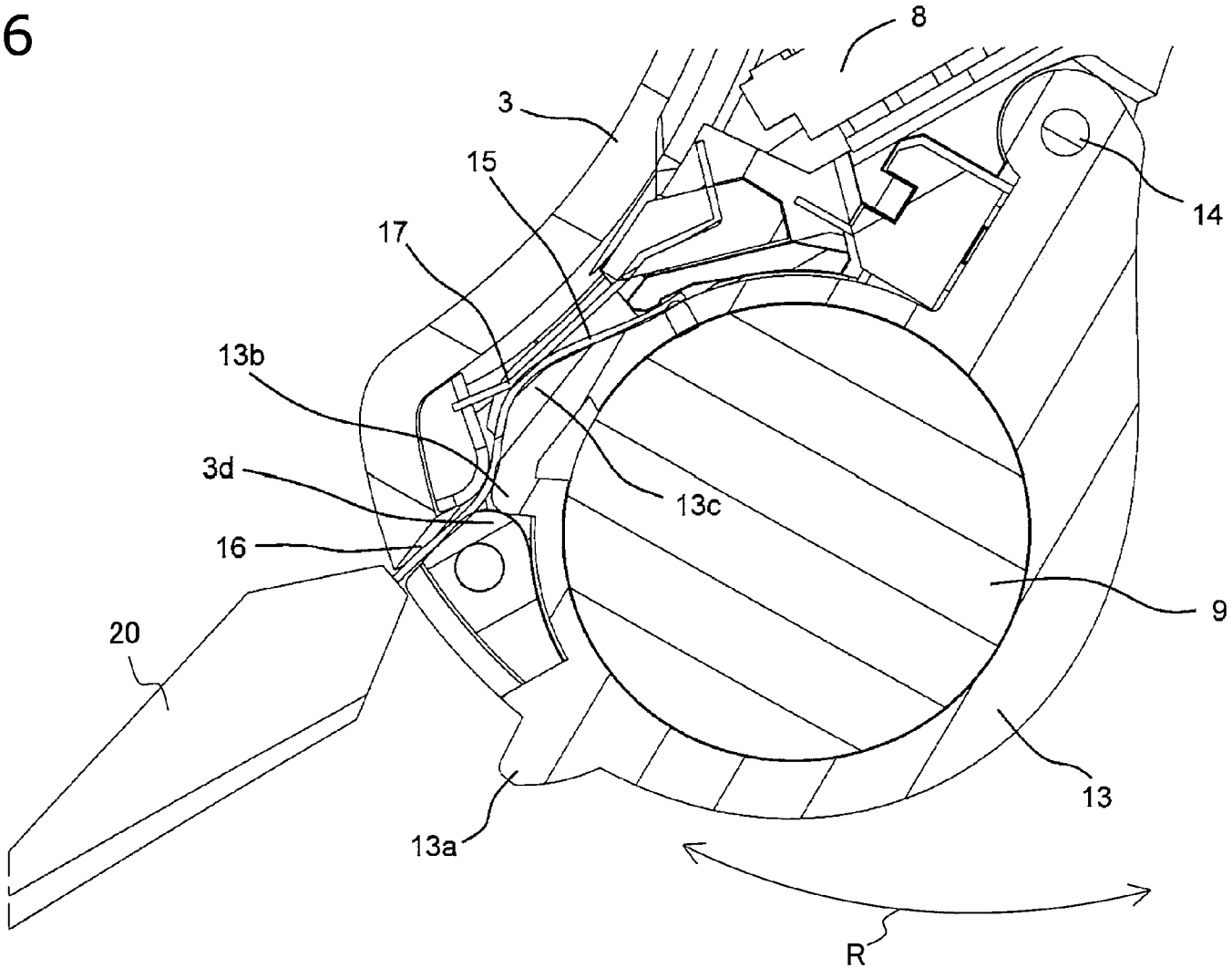
FIG. 6 is a front detail cross section of the hearing aid pertaining to an embodiment of the present invention.

Also, in this embodiment the battery 9 is housed at the rear end part of the main body case 3 as shown in FIGS. 4 to 6. The battery 9 is removably housed in a battery case 13 that can be stowed away or pulled out by rotation when the battery needs to be replaced.

As shown in FIGS. 4 to 6, the rotary shaft 14 of the battery case 13 is provided at the rear end part of the main body case 3, on the inside of the curve (that is, on the ear side when the hearing aid is worn). When the battery 9 is replaced, an opening protrusion 13*a* (not shown in FIG. 1A; see FIG. 3) of the battery case 13 located outside the main body case 3 in the state shown in FIG. 1A is rotated by finger to the right in FIG. 4 (that is, forward when the hearing aid is worn). When this is done, the battery case 13 rotates around rotary shaft 14 as shown in FIG. 4, and the battery case 13 is pulled out of the main body case 3. Accordingly, in this state the used battery 9 can be replaced with an unused battery 9.

After the battery 9 has been replaced, the battery case 13 is rotated to the left in FIG. 4 (that is, to the rear when the hearing aid is worn) around the rotary shaft 14, which stows the battery case 13 in the main body case 3. When the battery case 13 is thus housed in the main body case 3 along the rotation direction R, as shown in FIG. 6, a locking protrusion 13*b* provided to the battery case 13 is engaged with a locking protrusion 3*d* of the main body case 3. The battery case 13 is thus housed in a locked state inside the main body case 3.

As shown in FIGS. 4 to 6, an insertion opening 16 for inserting a communication terminal 15 used for fitting is provided at the rear end part of the main body case 3 on the outside of the curve (that is, on the opposite side from the ear when the hearing aid is worn).

Also, a communication terminal 17 for performing fitting is provided on the outside of the curve within the rear end part of the main body case 3, and during fitting the above-mentioned battery case 13 is pulled out as in FIG. 4, and in this state the communication terminal 15 is inserted through the insertion opening 16 as shown in FIGS. 4 and 5.

Since the battery case 13 is pulled out here, as shown in FIG. 5, the relative positions of the communication terminals 15 and 17 and the insertion state of the communication terminal 15 in the space S in which the battery case 13 is housed can be visually checked from the outside of the main body case 3 (such as in the arrow directions E, F, and G), which makes the work easier. After the relative positions of the communication terminals 15 and 17 have been checked visually, and the battery case 13 is moved from the state in FIGS. 4 and 5 to being housed in the main body case 3 as shown in FIG. 6, the communication terminal 15 is pressed against the communication terminal 17 by a pressing protrusion 13*c* of the battery case 13. This keeps the communication terminals 15 and 17 electrically connected. Therefore, in this state fitting is performed by driving the control element 8 with a hearing aid adjustment apparatus 20.

INDUSTRIAL APPLICABILITY

An electrical connection part and a microphone are provided in that order inside a main body case, from the front end side toward the rear end side of the main body case. A front sound opening is provided to the outer peripheral portion of the electrical connection part out of the outer wall face of the main body case, or to the front end side portion of the main body case from the electrical connection part, and a rear sound opening is provided to the rear of the front sound opening out of the outer wall face of the main body case. The front sound opening and the microphone are acoustically connected via a front sound guide path formed in the outer peripheral portion of the electrical connection part. Thus disposing the front sound opening more to the front end side of the main body case than in the past allows the front sound opening and rear sound opening to be separated far enough apart in the horizontal direction (the front and rear direction when the hearing aid is worn). As a result, it is easier to tell whether the sound source is in front or behind. Also, since there is adequate distance between the front sound opening and rear sound opening, the size of the main body case can be reduced correspondingly, and this makes the main body case more comfortable to wear. Therefore, it is expected to find use as a hearing aid.

REFERENCE SIGNS LIST

1 ear hook
2 earphone

3 main body case
3*a* front end opening
3*b* front sound opening
3*c* rear sound opening
3*d* locking protrusion
4 wiring
5 electrical connection part
5*a* plug
5*b* receptacle
6 front microphone
7 rear microphone
8 control element
9 battery
10 front sound guide path
11, 12 dust filter
13 battery case
13*a* opening protrusion
13*b* locking protrusion
13*c* pressing protrusion
14 rotary shaft
15 communication terminal
16 insertion opening
17 communication terminal
20 hearing aid adjustment apparatus

The invention claimed is:

1. A hearing aid, comprising:

an ear hook bent for hooking;

an earphone linked to a front end side of the ear hook; and a main body case linked to a rear end side of the ear hook, wherein the ear hook has a wiring electrically connecting the earphone and the main body case, the main body case has:

a electrical connection part electrically connected with the wiring, a front microphone, and a rear microphone provided in that order, from the front end side to the rear end side of the main body case, inside the main body case;

a front sound hole provided to the outer peripheral portion of the electrical connection part or to the front end side portion of the main body case from the electrical connection part, out of the outer wall face of the main body case; and a rear sound hole provided to the rear of the front sound hole out of the outer wall face of the main body case, the front sound hole and the front microphone are acoustically connected via a front sound guide path, the front sound guide path has a first space formed between the inner wall face of the main body case and the outer peripheral portion of the electrical connection part, and a second space formed between the electrical connection part and the front microphone, the front sound hole is provided to the outer wall face of the main body case corresponding to the first space, and the rear sound hole and the rear microphone are acoustically connected.

2. The hearing aid according to claim 1, wherein the electrical connection part is constituted by a plug provided to either the ear hook or the main body case, and a receptacle provided to the other.

3. The hearing aid according to claim 1, wherein the front sound hole is constituted by a pair of sound holes provided on the right and left sides of a line going from the front end side toward the rear end side of the main body case.

4. The hearing aid according to claim 1, wherein the main body case has a shape that hangs down while curving in a parabolic form from the front end side toward the rear end side of the main body case.

5. The hearing aid according to claim 4, wherein the rear sound hole is provided lower than the front sound hole.

* * * * *